US010676305B2

(12) United States Patent
Doi

(10) Patent No.: US 10,676,305 B2
(45) Date of Patent: Jun. 9, 2020

(54) CUTTING APPARATUS AND IMAGE FORMING APPARATUS

(71) Applicant: CANON KABUSHIKI KAISHA, Tokyo (JP)

(72) Inventor: Shigeo Doi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 44 days.

(21) Appl. No.: 15/593,003

(22) Filed: May 11, 2017

(65) Prior Publication Data

US 2017/0341895 A1 Nov. 30, 2017

(30) Foreign Application Priority Data

May 31, 2016 (JP) ..... 2016-109278

(51) Int. Cl.

| | |
|---|---|
| ***B65H 29/24*** | (2006.01) |
| ***B26D 7/18*** | (2006.01) |
| ***B65H 29/12*** | (2006.01) |
| ***B65H 35/06*** | (2006.01) |
| ***G03G 15/00*** | (2006.01) |
| ***B65H 45/18*** | (2006.01) |

(Continued)

(52) U.S. Cl.

CPC ..... *B65H 29/245* (2013.01); *B26D 7/0675* (2013.01); *B26D 7/18* (2013.01); *B26D 7/1854* (2013.01); *B65H 29/12* (2013.01); *B65H 31/00* (2013.01); *B65H 35/06* (2013.01); *B65H 45/18* (2013.01); *G03G 15/6582* (2013.01); *B26D 1/08* (2013.01); *B26D 7/025* (2013.01); *B65H 2301/4229* (2013.01); *B65H 2701/18271* (2013.01); *B65H 2801/27* (2013.01); *G03G 2215/00814* (2013.01)

(58) Field of Classification Search

CPC ..... B26D 7/1845; B26D 7/1854; B26D 2007/0018; Y10T 83/2074; B26B 2301/4229; B65H 2301/4229

See application file for complete search history.

(56) References Cited

U.S. PATENT DOCUMENTS 5,377,569 A * 1/1995 Richards ..... B26D 7/1854 83/397
5,379,668 A * 1/1995 Standing ..... B26D 7/1854 83/167

(Continued)

FOREIGN PATENT DOCUMENTS

JP H07-172080 A 7/1995
JP 2008-184310 A 8/2008

(Continued)

*Primary Examiner* — Jennifer E Simmons
(74) *Attorney, Agent, or Firm* — Canon USA, Inc. IP Division

(57) ABSTRACT

A cutting apparatus includes a blade configured to cut a sheet that is conveyed along a sheet conveyance path, a scrap path through which scrap generated when the sheet is cut by the blade passes, a guide member configured to guide the sheet conveyed, and a blowing unit configured to blow air such that the air crosses the sheet conveyance path from a side opposite the scrap path with the sheet conveyance path therebetween, wherein the blowing unit blows air such that the air flows along the guide member positioned at a second position at which the scrap is allowed to enter the scrap path.

11 Claims, 11 Drawing Sheets

(51) Int. Cl.

| | |
|---|---|
| ***B26D 7/06*** | (2006.01) |
| ***B65H 31/00*** | (2006.01) |
| *B26D 7/02* | (2006.01) |
| *B26D 1/08* | (2006.01) |

(56) References Cited

U.S. PATENT DOCUMENTS

| | | | | |
|---|---|---|---|---|
| 6,532,856 | B2 * | 3/2003 | Kato | B26D 1/08<br>83/267 |
| 8,522,660 | B2 * | 9/2013 | Hayashi | B26D 5/20<br>270/58.04 |

FOREIGN PATENT DOCUMENTS

| | | | |
|---|---|---|---|
| JP | 2008-207958 | A | 9/2008 |
| JP | 2009-126690 | A | 6/2009 |
| JP | 2009-269157 | A | 11/2009 |

* cited by examiner

CUTTING APPARATUS AND IMAGE FORMING APPARATUS

BACKGROUND

Field of Art

The present disclosure relates to a cutting apparatus for cutting a sheet and an image forming apparatus including the cutting apparatus.

Description of the Related Art

A sheet on which an image is formed is conveyed to a cutting apparatus. The cutting apparatus partially cuts the conveyed sheet. The cutting apparatus is configured such that scrap (cutting scrap) generated when the sheet is cut falls into a scrap basket (Japanese Patent Application Laid-Open. No. 2008-207958).

The cutting scrap generated when the sheet is cut may adhere to a guide member that guides a sheet to be conveyed. In such a case, the cutting scrap adhering to the guide member contacts a subsequent sheet bundle. The contact of the cutting scrap with the subsequent sheet bundle causes the cutting scrap to be discharged with the subsequent sheet bundle. Consequently, a foreign substance (cutting scrap) is mixed with a product. Thus, the cutting scrap degrades the quality of the product.

SUMMARY

The present disclosure is directed to reduction of degradation in the quality of a product due to cutting scrap.

According to an aspect of an embodiment, a cutting apparatus that cuts a sheet on which an image is formed includes a sheet conveyance path along which a sheet to be conveyed passes, a blade configured to cut the sheet to be conveyed along the sheet conveyance path, a scrap path through which scrap generated when the sheet is cut by the blade passes, a guide member configured to be movable to a first position where the guide member blocks the scrap path and the guide member guides the sheet conveyed along the sheet conveyance path and to a second position where the scrap is allowed to enter the scrap path, and a blowing unit configured to blow air such that the air crosses the sheet conveyance path from a side opposite the scrap path, wherein the blowing unit blows air such that the air flows along the guide member at the second position into the scrap path.

Further features will become apparent from the following description of exemplary embodiments with reference to the attached drawings.

DESCRIPTION OF THE EMBODIMENTS

An apparatus according to each exemplary embodiment is described with reference to the drawings. Dimensions, materials, and relative arrangements among other features of components of the apparatus described in the exemplary embodiments are not intended to limit the scope of the present invention, unless otherwise specified as limiting the scope.

Figure 1:
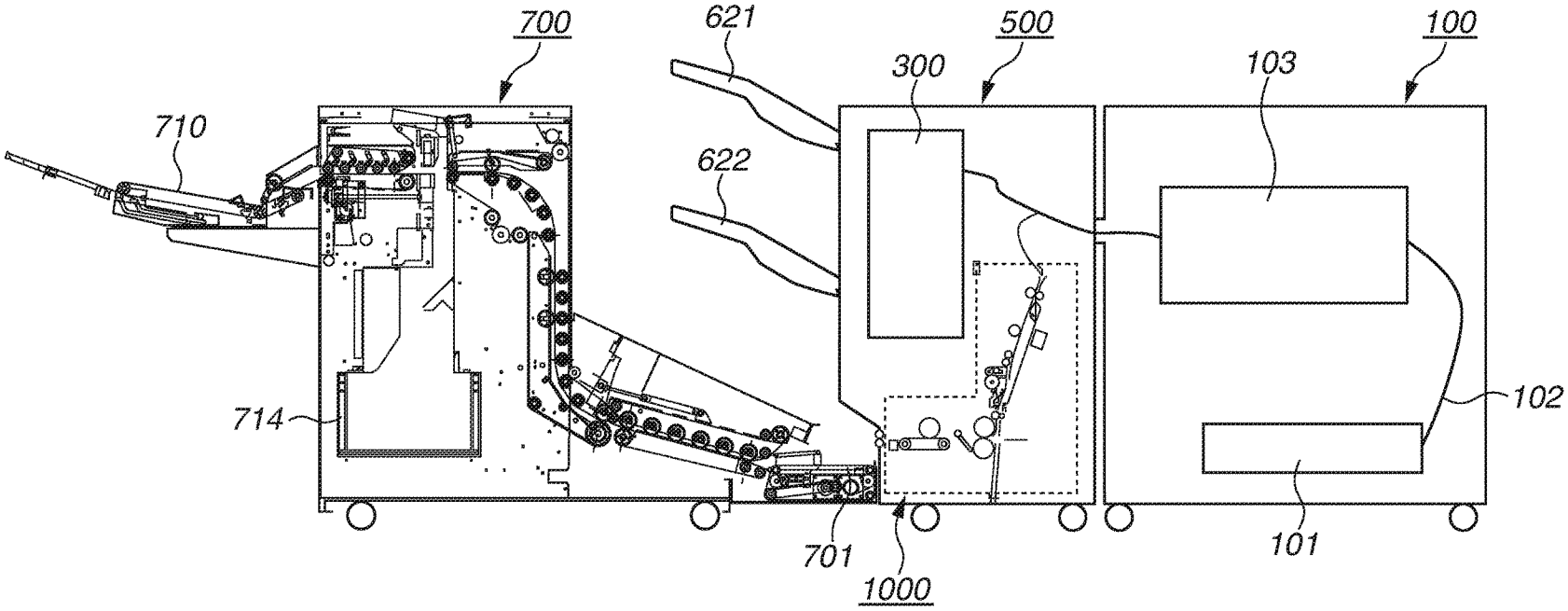
FIG. 1 is a sectional view of an image forming apparatus.

FIG. 1 is a diagram illustrating one example of a configuration of an image forming apparatus according to an exemplary embodiment.

In FIG. 1, the image forming apparatus includes a printer main body (an image forming apparatus main body) 100, a finisher 500, and a cutting apparatus 700 disposed on a downstream side of the finisher 500 in a sheet conveyance direction.

The printer main body 100 includes a sheet cassette 101 in which sheets are stored, and an image forming unit 103 that forms an image on a sheet conveyed from the sheet cassette 101 via a feeding path 102. The sheet on which the image is formed by the image forming unit 103 is conveyed to the finisher 500. Although the exemplary embodiments are described with an example which the printer main body 100 and the finisher 500 are separate members, the finisher 500 and the printer main body 100 can be integrated.

The finisher 500 includes a side stitching unit 300 and a folding bookbinding unit 1000. The side stitching unit 300 fits together the sheets conveyed from the printer main body 100 to tie the sheets in one bundle. Moreover, the side stitching unit 300 staples a trailing end of the sheet bundle with a staple. The sheets processed by the side stitching unit 300 are discharged to a discharge tray 621 and/or 622.

Figure 3:
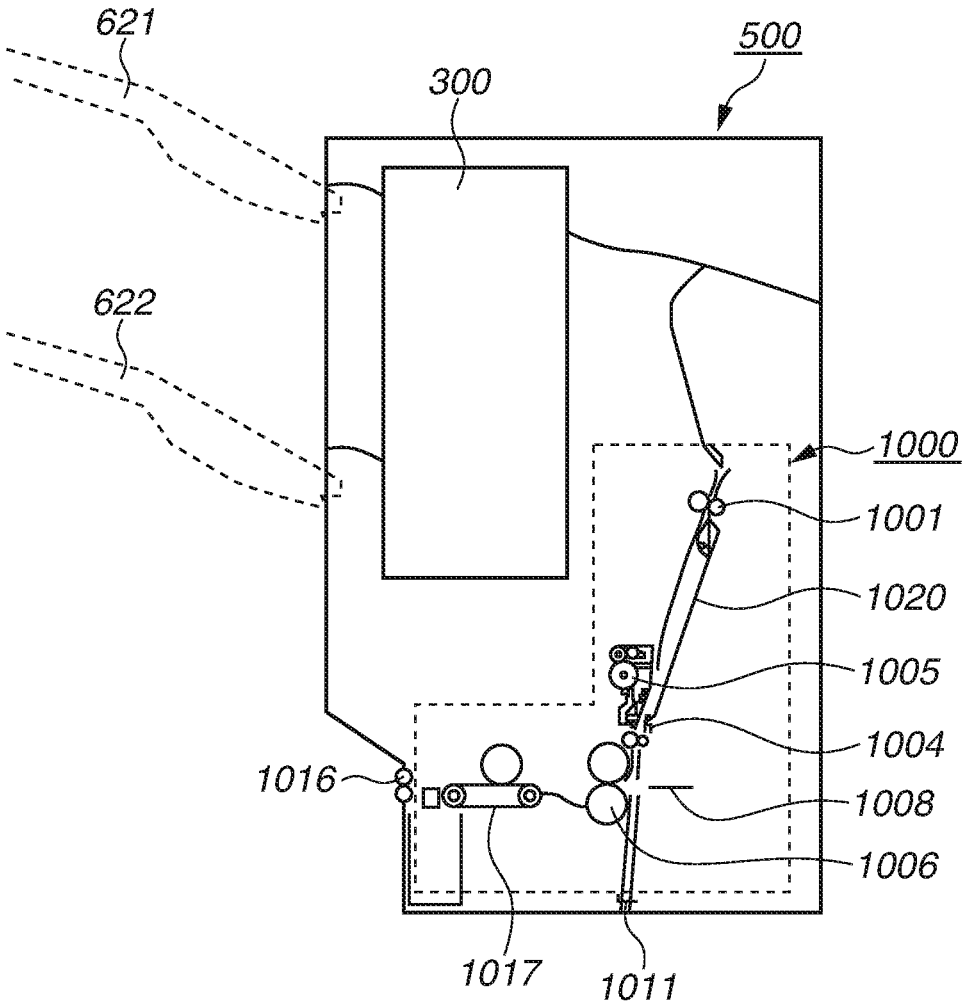
FIG. 3 is a sectional view of a finisher.

As illustrated in FIG. 3, the folding bookbinding unit 1000 is provided with a storage guide 1020 in which a sheet conveyed from the printer main body 100 is stored. The sheet conveyed into the storage guide 1020 is conveyed until a leading end of the sheet (a lower end of the sheet) contacts a movable sheet-positioning member 1011.

Two staplers 1005 are provided in a middle portion of the storage guide 1020. An anvil 1004 is disposed to face the stapler 1005. The stapler 1005 and the anvil 1004 cooperate with each other, so that the sheet bundle is bound (by saddle-stitching) at a center portion thereof.

On a downstream side of the stapler 1005, a folding process unit is disposed. The folding process unit includes a folding roller pair 1006 as a folding unit, and a projecting member 1008 disposed to face the folding roller pair 1006. A saddle stitching process or a folding process is performed while a leading end position of sheets is being regulated by the sheet positioning member 1011.

The sheet bundle folded by the folding roller pair 1006 is conveyed to a conveyance belt 1017, and then conveyed to the cutting apparatus 700 serving as a subsequent post-processing apparatus by a discharge roller 1016.

Figure 4:
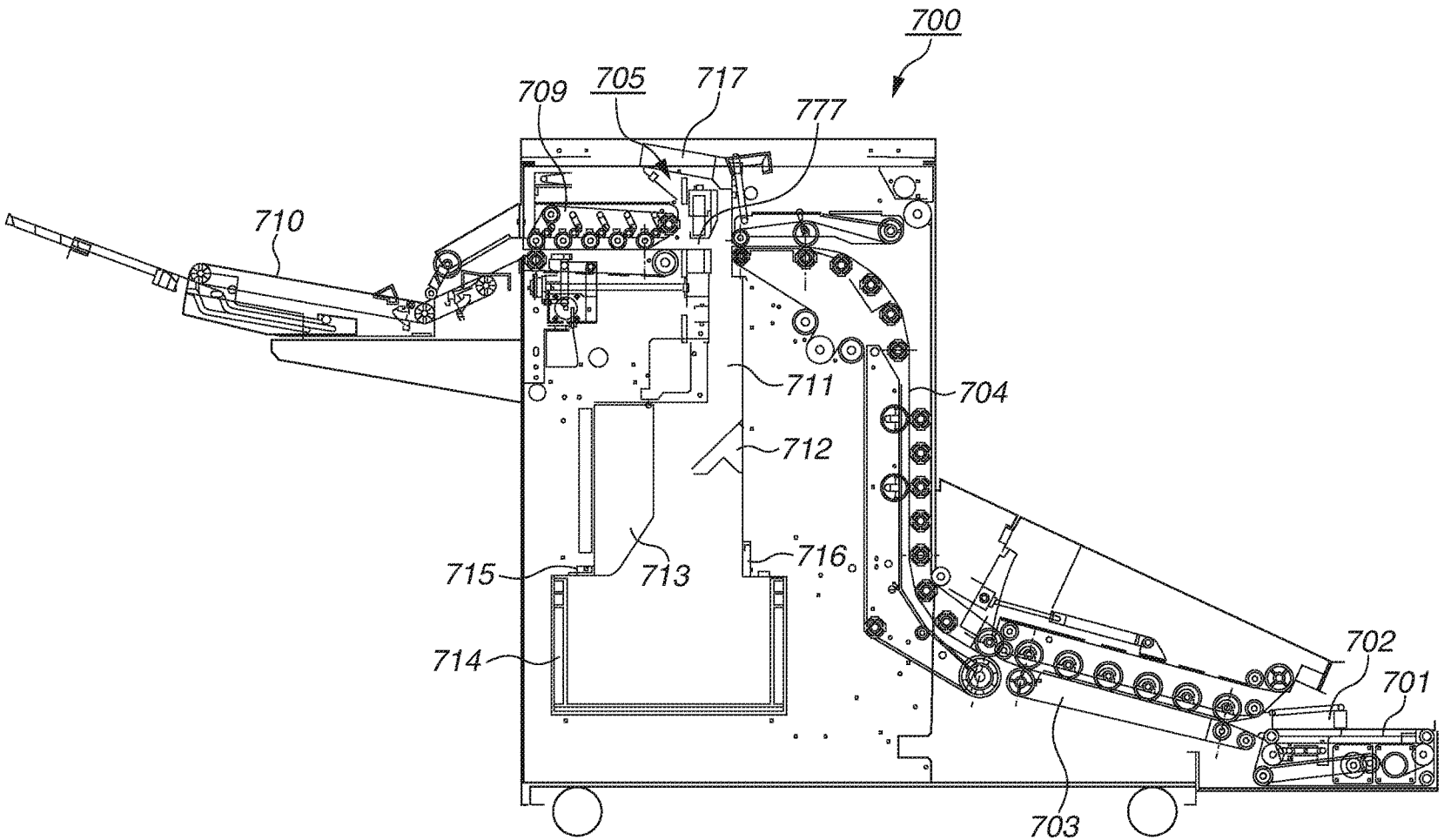
FIG. 4 is a sectional view of a cutting apparatus.

FIG. 4 is a sectional view of the cutting apparatus 700. Here, the finisher 500 and the cutting apparatus 700 of separate members are described as an example. However, the finisher 500 and the cutting apparatus 700 may be integrated.

In the cutting apparatus 700, a receiving conveying unit 701 is disposed on an upstream side in a conveyance direction. The receiving conveying unit 701 includes a receiving conveyance belt which receives the sheet bundle discharged by the discharge roller 1016 of the finisher 500 on an upper surface of the receiving conveyance belt, and then conveys the sheet bundle by rotating.

A side regulating plate 702 corrects a skew and a position in a main scanning direction of the sheet bundle received by the receiving conveying unit 701. The sheet bundle with the position and the skew corrected by the side regulating plate 702 is fed into an inlet conveyance unit 703. The inlet conveyance unit 703 includes a pair of conveyance belts that nip and convey the sheet bundle, so that the sheet bundle is conveyed diagonally upward.

The sheet bundle conveyed by the inlet conveyance unit 703 is conveyed to a vertical path conveyance unit 704 serving as a conveyance unit. The vertical path conveyance unit 704 includes a pair of conveyance belts that nip and convey the sheet bundle along a sheet conveyance path 777. The sheet bundle is fed by the vertical path conveyance unit 704 to a cutting unit 705 that cuts the sheet bundle. The sheet fed from the finisher 500 by the receiving conveying unit 701 and the vertical path conveyance unit 704 is conveyed to the cutting unit 705 disposed in a position higher that of the receiving conveying unit 701 in which the cutting apparatus 700 receives the sheets.

The cutting unit 705 cuts (described in detail below) a fore edge side of the sheet bundle according to a preset cutting width. The fore edge of the sheet bundle represents an end of the opposite side of a folding portion of the sheet bundle. The sheet bundle the end portion of which is cut is discharged from a discharge conveyance unit 709 to a discharge tray 710, and is stacked on the discharge tray 710. The discharge conveyance unit 709 includes a pair of conveyance belts. The discharge conveyance unit 709, which includes a pair of the conveyance belts, conveys the sheet bundle to discharge the sheet bundle to the discharge tray 710 with the pair of the conveyance belts.

A sheet fragment (hereinafter called cutting scrap) generated in cutting of sheets passes a scrap discharge path 711 extending downward from the cutting unit 705, and then falls toward a container 714. The container 714 as a storage unit that stores cutting scrap is disposed to be attachable to and detachable from the front side of the cutting apparatus 700. The cutting scrap falls while being guided by an oblique guide 712 and a regulation guide 713, and is accumulated in the container 714.

When a certain amount of cutting scrap is accumulated in the container 714, an operator pulls out the container 714 from the cutting apparatus 700, and removes the accumulated cutting scrap from the container 714.

The cutting apparatus 700 includes a detection unit that detects a full-load of the cutting scrap accumulated in the container 714. As illustrated in FIG. 4, a detecting sensor light emitting unit 715 and a detecting sensor light receiving unit 716 are positioned slightly higher than the container 714. When the container 714 is filled with the cutting scrap, light emitted from the detecting sensor light emitting unit 715 is blocked by the accumulated cutting scrap. When the cutting apparatus 700 confirms that the light is not received by the detecting sensor light receiving unit 716 for a certain time or longer, the cutting apparatus 700 determines that the container 714 is full. The cutting apparatus 700 then prompts not only removal of the cutting scrap from the container 714, but also temporary stop of do image forming apparatus system as whole.

Figure 2:
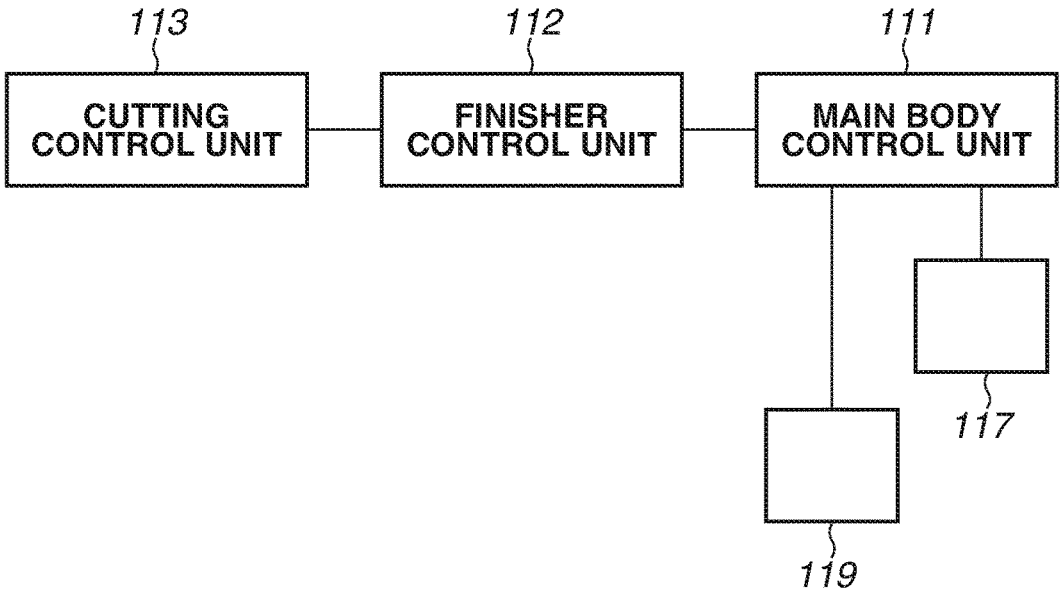
FIG. 2 is a block diagram of the image forming apparatus.

FIG. 2 is a control block diagram of the image forming apparatus. The printer main body 100 includes a main body control unit 111. The main body control unit 111 controls an image formation control unit 117 that controls an operation for image formation. The main body control unit 111 is configured so as to communicate with an external device via an interface 119. A finisher control unit 112 and a cutting control unit 113 are connected to the main body control unit 111. The finisher control unit 112 controls the finisher 500, whereas the cutting control unit 113 controls the cutting apparatus 700.

Next, a configuration of the cutting unit 705 is described in detail with reference to FIGS. 5 and 6.

The cutting unit 705 includes an upper blade 722 and a lower blade 723. The upper blade 722 vertically moves to cut one portion of a sheet bundle S. The lower blade 723 is fixed, and cuts the sheet bundle S with the upper blade 722. The upper blade (movable blade) 722 and the lower blade (fixed blade) 723 serving as cutting members are arranged between the vertical path conveyance unit 704 and the discharge conveyance unit 709.

A pressing member 724 is disposed between the lower blade 723 and the discharge conveyance unit 709 so that misalignment of sheets of the sheet bundle S is prevented when the sheets are cut.

An air blowing device 717 is disposed above the cutting unit 705. The air blowing device 717 as an air blowing unit includes one or more fans that are rotated by a motor to generate an air current (air). The cutting unit 705 includes ducts 720 and 721 that send the air generated by the air blowing device 717 to a cutting position at which the sheet bundle is cut by a pair of blades (the upper blade 722 and the lower blade 723). That is, the ducts 720 and 721 are arranged such that end portions (blowing ports) on a downstream side in an airflow direction of the ducts 720 and 721 are arranged to face the upper blade 722 and the lower blade 723. The air blowing port of the duct 721 extends along a sheet width direction intersecting with the sheet conveyance direction.

Figure 5:
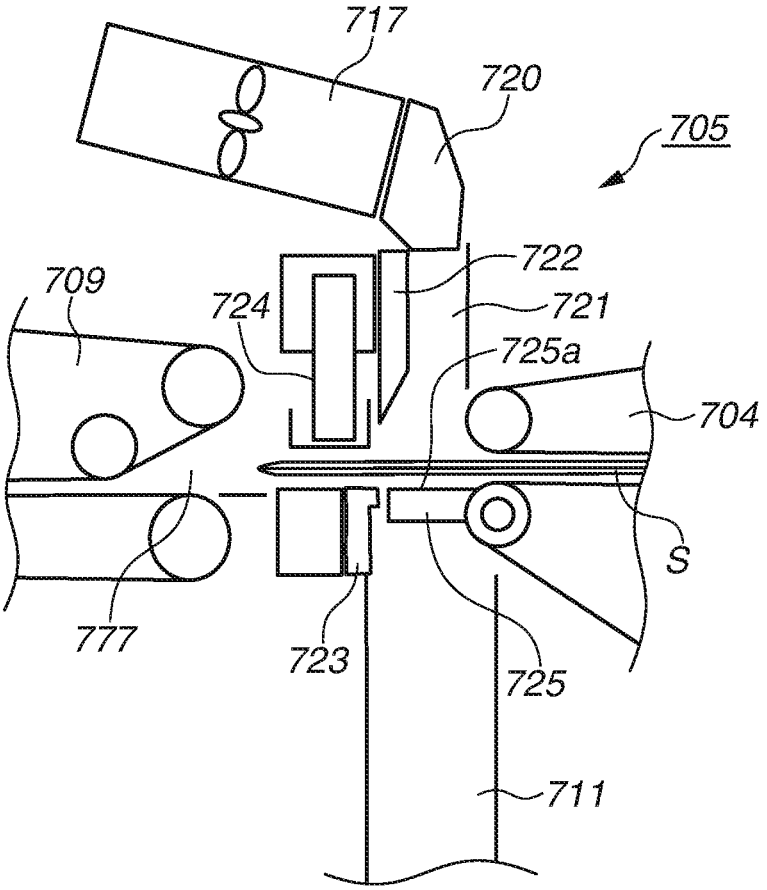
FIG. 5 is a diagram of a cutting unit.
Figure 6:
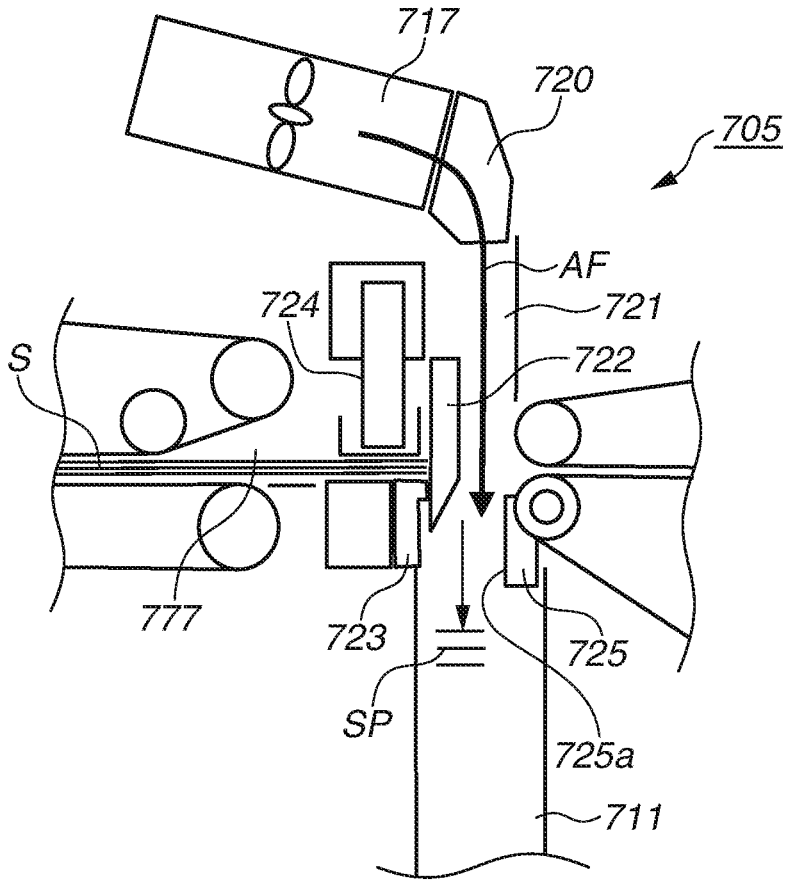
FIG. 6 is a diagram of the cutting unit.

As illustrated in FIGS. 5 and 6, the air blowing device 717 is disposed above the conveyance path 777, and the scrap discharge path 711 is disposed below the conveyance path 777. That is, the air-blowing device 717 is disposed at a side opposite the scrap discharge path 711 with the conveyance path 777 therebetween.

The scrap discharge path 711 is disposed between the container 714 (see FIG. 4) and the cutting position at which the sheet bundle is cut by upper blade 722 and the lower blade 723, and extends in a substantially vertical direction. The scrap discharge path 711 couples the container 714 with the pair of blades (the upper blade 722 and the lower blade 723), and serves as a path through which cutting scrap SP from the cutting position toward the container 714 (see FIG. 4) passes. As illustrated in FIG. 5, the scrap discharge path 711 is disposed such that an inlet (an upper end) of the scrap discharge path 711 is disposed to face an upstream portion in the conveyance direction relative to the cutting position and the cutting position.

A shutter member 725 that can open and close the scrap discharge path 711 is movably disposed in the inlet of the scrap discharge path 711 through which the cutting scrap SP is discharged.

Figure 10:
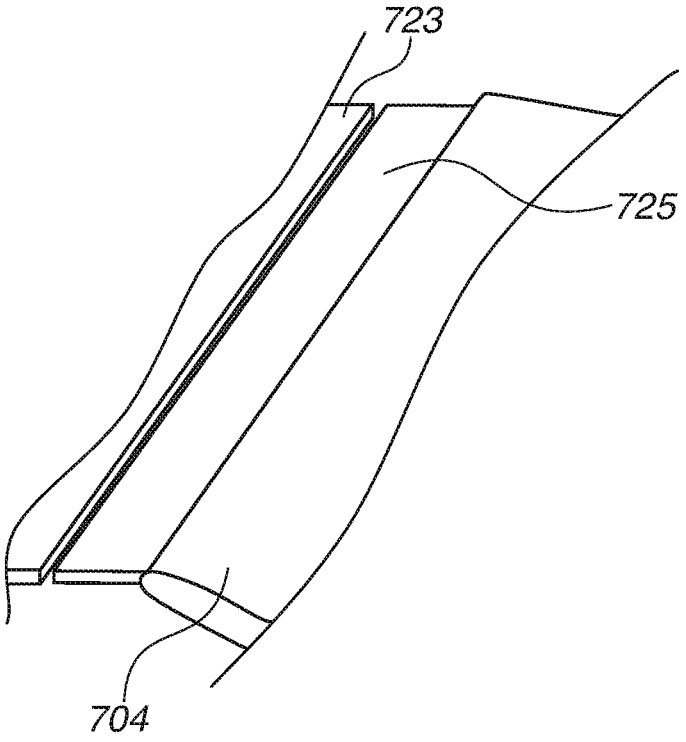
FIG. 10 is a schematic diagram of the cutting unit.

The shutter member 725 extends in the sheet width direction intersecting with the conveyance direction as illustrated in FIG. 10 of a schematic view in which the upper blade 722, the air blowing device 717, and an upper belt of the vertical path conveyance unit 704 are omitted for the sake of simplicity.

The shutter member 725 is rotatably supported around a fulcrum (end portion) on an upstream side, which is a distant side as viewed from the lower blade 723, in the conveyance direction. The shutter member 725 is urged by a spring (not illustrated) to a guide position (a first position) illustrated in FIG. 5. The shutter member 725 is moved by a solenoid 302 (see FIG. 7) to a retracted position (a second position) in which at least one portion of the shutter member 725 enters within the scrap discharge path 711 as illustrated in FIG. 6.

The shutter member 725 serving as a guide member guides the bottom of the sheet bundle conveyed from the vertical path conveyance unit 704 with a guide surface 725*a* thereof. That is, when the shutter member 725 is in the guide position to block the inlet of the scrap discharge path 711 (see FIG. 5), the shutter member 725 guides the sheet bundle to the lower blade 723 such that the conveyed sheets do not enter the scrap discharge path 711.

As illustrated in FIG. 6, when the shutter member 725 is rotated downward, the duct 721 and the scrap discharge path 711 are in airflow (AF) communication with each other. As illustrated in FIG. 6, the shutter member 725 is rotated to a position at which a downstream end thereof in the conveyance direction faces downward in the scrap discharge path 711. With the shutter member 725 positioned in the retracted position illustrated in FIG. 6, the pair of blades (the upper blade 722 and the lower blade 723) and the scrap discharge path 711 are in airflow communication with each other. This enables the cutting scrap generated when the sheet cutting is performed to enter the scrap discharge path 711. In the present exemplary embodiment, the rotation angle of the shutter member 725 is between 80 and 90 degrees, but is not limited thereto.

Figure 7:
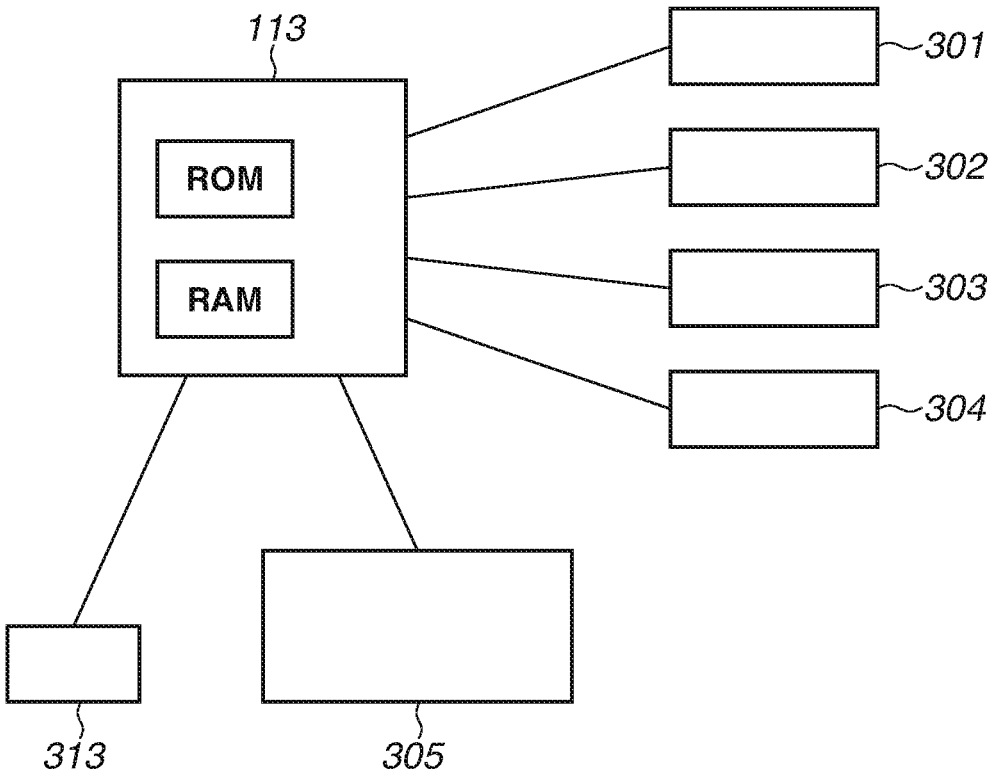
FIG. 7 is a block diagram of the cutting apparatus.

FIG. 7 is a control block diagram of the cutting apparatus 700. The cutting control unit 113 (hereinafter called a control unit 113) controls a cut motor 301 that vertically moves the upper blade 722. Moreover, the control unit 113 controls the solenoid 302 which moves the shutter member 725, and an elevation motor 303 that vertically moves the pressing member 724. The control unit 113 controls a fan motor 304 that rotates the fans of the air blowing device 717. The control unit 113 receives a signal from a sensor 313 that detects a sheet to be conveyed. The sensor 313 is disposed in each of the receiving conveying unit 701, the vertical path conveyance unit 704, and the discharge conveyance unit 709. The control unit 113 controls a load 305 of a motor for conveyance of the sheet bundle by, for example, the receiving conveying unit 701, the vertical path conveyance unit 704, and the discharge conveyance unit 709.

Figure 8:
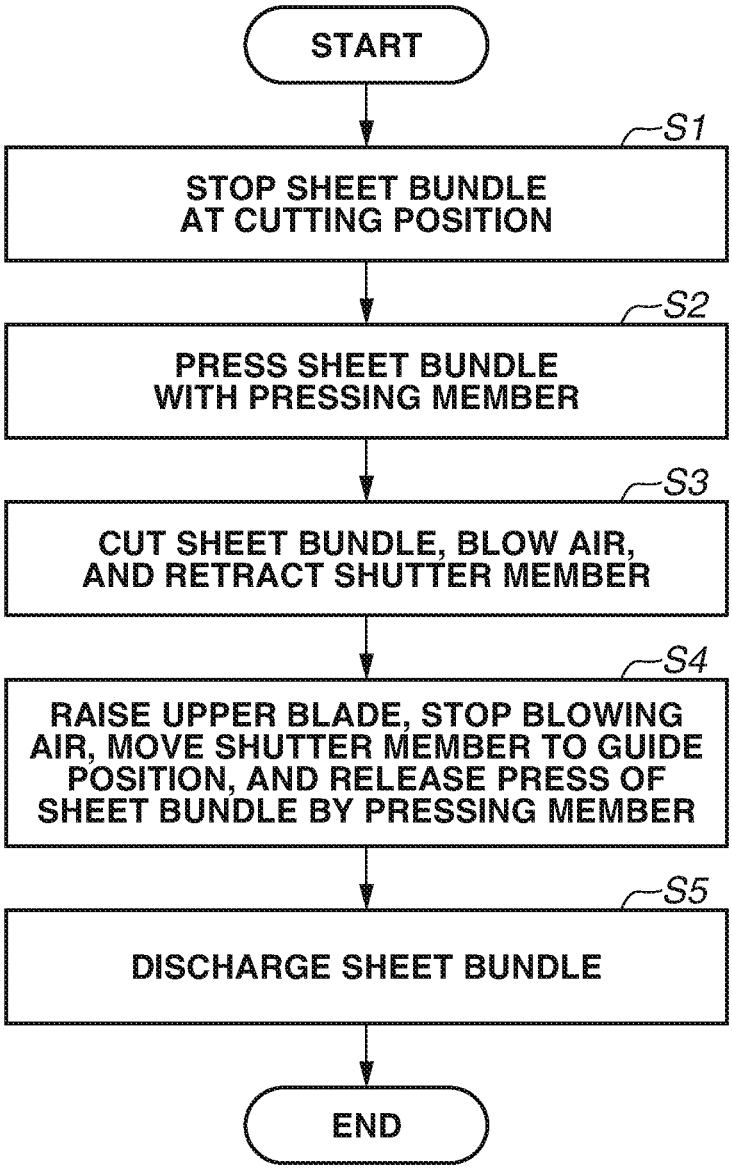
FIG. 8 is a flowchart of operation performed by the cutting apparatus.

Hereinafter, a cutting operation performed by the cutting apparatus 700 is described in detail with reference to FIGS. 5 and 6 and a flowchart illustrated in FIG. 8. The operation in the flowchart illustrated in FIG. 8 is executed by the control unit 113 while the control unit 113 is using a RAM as a working area according to a program stored in a ROM.

As illustrated in FIG. 5, when a sheet bundle S is fed from the vertical path conveyance unit 704 to the cutting unit 705, each of the upper blade 722 and the pressing member 724 is in a standby position on an upper side. In this state, the air blowing device 717 is at a stop, and the shutter member 725 is closed with respect to the scrap discharge path 711 as illustrated in FIG. 5. The guide surface 725*a* of the shutter member 725 guides the sheet bundle S to be conveyed. Then, in step S1, the discharge conveyance unit 709 stops the sheet bundle S at a position at which a designated amount can be cut from the sheet bundle S. That is, the control unit 113 controls a motor used for conveyance of the sheet bundle S by the discharge conveyance unit 709, so that the sheet bundle S is stopped in a predetermined stop position. The term "stop position" used herein represents a position at which a trailing end portion of the sheet bundle S projects from the lower blade 723 toward the upstream side in the conveyance direction by an amount to be cut when a folding portion of the sheet bundle S is conveyed as a lead.

Subsequently, in step S2, the control unit 113 operates the elevation motor 303 to move the pressing member 724 downward. Accordingly, the pressing member 724 and a guide facing the pressing member 724 nip the sheet bundle S, so that the sheet bundle S is fixed.

In step S3, referring to FIG. 6, the control unit 113 controls the cut motor 301 to move the upper blade 722 downward with respect to the sheet bundle S being at a stop. At that time, the control unit 113 drives the solenoid 302 to rotate the shutter member 725 to the retracted position illustrated in FIG. 6, and operates the fan motor 304 for rotating the fans of the air blowing device 717.

With the downward movement of the upper blade 722, the trailing end portion of the sheet bundle S is cut by the upper blade 722 and the lower blade 723.

As described above, when the upper blade 722 is moved to cut the sheet bundle S, the control unit 113 controls the solenoid 302 to move the shutter member 725 to the retracted position illustrated in FIG. 6. In other words, the shutter member 725 pivots around a pivot shaft on the upstream side in the conveyance direction such that a conveyance direction downstream side end portion of the guide surface 725*a* faces downward (FIG. 6). The movement of the shutter member 725 to the retracted position illustrated in FIG. 6 opens the inlet of the scrap discharge path 711 that has been blocked, so that the scrap discharge path 711 and the air blowing port of the duct 721 are in airflow communication with each other.

The cutting scrap SP generated by the cutting operation performed by the downward movement of the upper blade 722 passes an area near the shutter member 725 in the retracted position, and is fed to the container (storage unit) 714 via the scrap discharge path 711.

The air blowing device 717 blows air when the shutter member 725 is in the retracted position illustrated in FIG. 6 while the upper blade 722 is moving downward. The air from the air blowing device 717 is sent to the cutting position as a working position between the shutter member 725, the lower blade 723, and the upper blade 722 via the ducts 720 and 721. The air from the air blowing device 717 flows along the guide surface 725*a* of the shutter member 725 positioned in the retracted position illustrated in FIG. 6. Moreover, the air from the air blowing device 717 flows downward in a movement direction of the upper blade 722 along a side surface of the upper blade 722 or a side surface of the lower blade 723. The cutting scrap generated when the sheet cutting is performed is blown downward inside the scrap discharge path 711 by the air.

In other words, the air from the air blowing device 717 blows off the cutting scrap downward in the scrap discharge path 711 without adhesion of the cutting scrap to the guide surface 725*a* of the shutter member 725, the side surface of the lower blade 723, or the side surface of the upper blade 722.

After the cutting is finished, the processing proceeds to step S4 of the flowchart illustrated in FIG. 8. In step S4, the control unit 113 controls the elevation motor 303 such that the pressing member 724 is raised toward the retracted position to release the press of the sheet bundle S by the pressing member 724. Concurrently with the raising operation of the pressing member 724, the control unit 113 controls the cut motor 301 such that the upper blade 722 is raised to return to the retracted position. Moreover, the control unit 113 stops driving the solenoid 302 such that the shutter member 725 returns to the original guide position by urging force of a spring. The control unit 113 stops the air blowing device 717 to stop supplying the air in synchronization with closing of the shutter member 725.

In step S5, the control unit 113 drives the discharge conveyance unit 709 such that the sheet bundle with the cut trailing end is discharged.

In the sheet cutting, the air blowing device 717 is operated to blow air to the cutting position. Hereinafter, working and effects related to such air blowing are described in detail.

Cutting scrap SP charged with static electricity or cutting scrap SP with water droplets due to dew condensation may adhere to the upper blade 722 or the lower blade 723, an inner surface of the scrap discharge path 711, and the shutter member 725, particularly, the guide surface 725*a*.

Even in a case where such cutting scrap SP adheres, the air blows off the cutting scrap SP from the upper blade 722 or the lower blade 723, the inner surface of the scrap discharge path 711, and the shutter member 725, particularly, the guide surface 725*a*. Accordingly, the cutting scrap SP is removed from the upper blade 722 or the lower blade 723, and the guide surface 725*a* of the shutter member 725 by the air. Quantity or speed of the air of the air blowing device 717 is not particularly limited to a numeric value as long as quantity or speed of the air is set on condition that the aforementioned purpose is achieved.

In a case where cutting scrap SP remains adhering to the upper blade 722, the lower blade 723, or the shutter member 725 with the air being not sent by the air blowing device 717, the following problem may occur. That is, in a case where a subsequent sheet bundle S is cut in a state where the cutting scrap adheres to the upper blade 722, the lower blade 723, and the shutter member 725, the cutting scrap SP enters between the upper blade 722 and the lower blade 723. This degrades an end result of cutting.

In a case where a subsequent sheet bundle S is fed in a state where the cutting scrap SP adheres to the guide surface 725*a* of the shutter member 725, quality of a product is degraded. Specifically, in a case where the cutting scrap SP adheres to a subsequent sheet bundle S, or the cutting scrap SP is pushed by a leading end of a subsequent sheet bundle S, the cutting scrap SP is discharged from a discharge port of the cutting apparatus 700. The discharge of the cutting scrap from the discharge port from which only a cut sheet bundle is normally to be discharged results in getting the cutting scrap into the sheet bundle as a product, causing degradation in quality of the product. Moreover, in a case where cutting scrap adheres to an inner surface of the scrap discharge path 711, the portion with the cutting scrap may block cutting scrap.

In the present exemplary embodiment, such an issue can be solved by blowing of the air from the air blowing device 717 to send the cutting scrap SP to the container 714.

The air blowing by the air blowing device 717 can be executed at a time when at least the scrap discharge path 711 is opened by movement (retraction) of the shutter member 725 from the guide position.

However, the operation of the air blowing device 717 only in a state in which the shutter member 725 is opened as described above can reduce power consumption, compared with a case in which the air blowing device 717 is constantly operated.

In a case where the air blowing device 717 is operated even in a state in which the shutter member 725 is closed, an airflow strength is desirably set so as to differ from that used when the shutter member 725 is opened (when cutting is performed). When the shutter member 725 is closed, for example, an airflow strength is desirably set to low, which is different from that used when the cutting operation is performed. The low airflow can ease issues caused by paper dust generated from a sheet bundle or a flow of dust floating inside the apparatus flowing into various places by air.

Moreover, the exemplary embodiment has been described with an example in which rotation of the shutter member 725 to a retracted position is started at the same time as downward movement of the upper blade 722. However, the downward movement of the upper blade 722 and the rotation of the shutter member 725 may not be performed at the same time. For example, after the shutter member 725 is rotated to the retracted position illustrated in FIG. 6, the upper blade 722 can be moved downward to cut a sheet bundle.

The exemplary embodiment has been described with an example in which rotation of the fans of the air blowing device 717 is stopped to stop the air blowing from a state in which the air blowing device 717 blows air. However, the exemplary embodiment is not limited thereto. For example, a flow of air can be blocked by a shielding member disposed in the duct 720 to stop the air blowing.

Moreover, a specific configuration of the air blowing device is not limited to that described above. The exemplary embodiment has been described with an example in which a plurality of fans is used to blow air. However, compressed air generated by a device, such as a compressor, may be blown to prevent adhesion of cutting scrap.

Figure 9A:
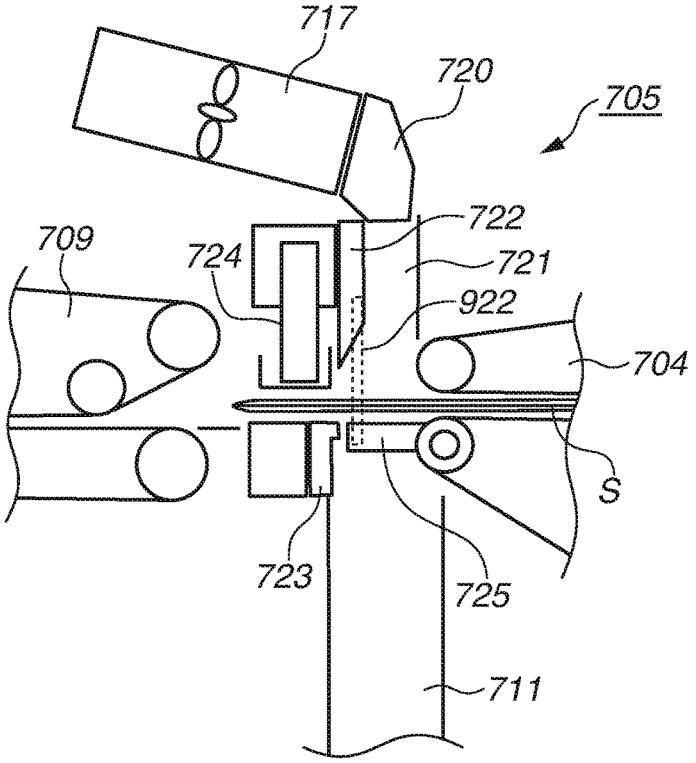
FIGS. 9A and 9B are diagrams of a modification example of the cutting apparatus.
Figure 9B:
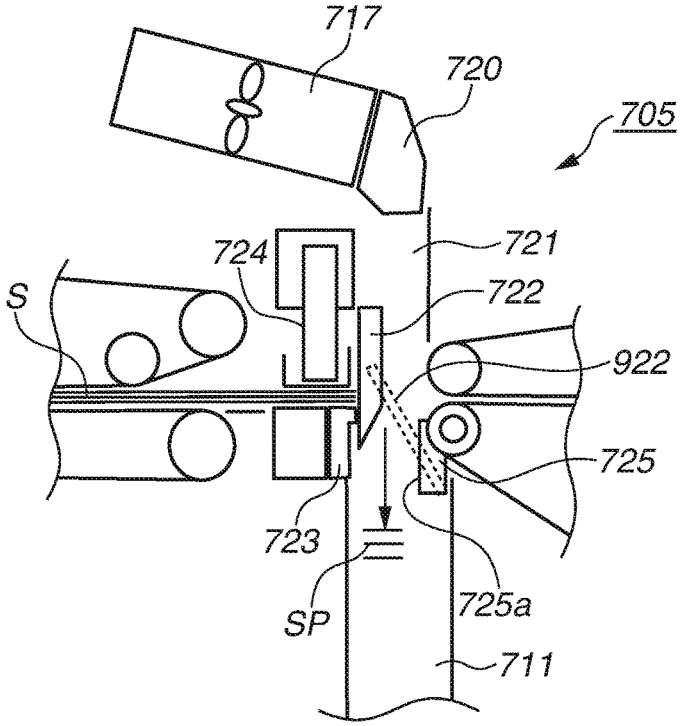

Moreover, the exemplary embodiment has been described using a case in which the upper blade 722 and the shutter member 725 are respectively driven by the cut motor 301 and the solenoid 302. In other words, the upper blade 722 and the shutter member 725 are driven by different drive sources. However, the upper blade 722 and the shutter member 725 may be moved by driving forces from a common drive source. For example, as illustrated in FIGS. 9A and 9B, the upper blade 722 and the shutter member 725 can be connected via a link member 922 so as to operate in response to each other.

Moreover, the exemplary embodiment has been described with an example in which the shutter member 725 and the pressing member 724 are operated by the different drive sources. However, the shutter member 725 and the pressing member 724 may be moved by driving forces from a common drive source. Similarly, the upper blade 722 and the pressing member 724 may be moved by driving forces from a common drive source. Moreover, the upper blade 722, the pressing member 724, and the shutter member 725 may be moved by driving forces from a common drive source.

Figure 11:
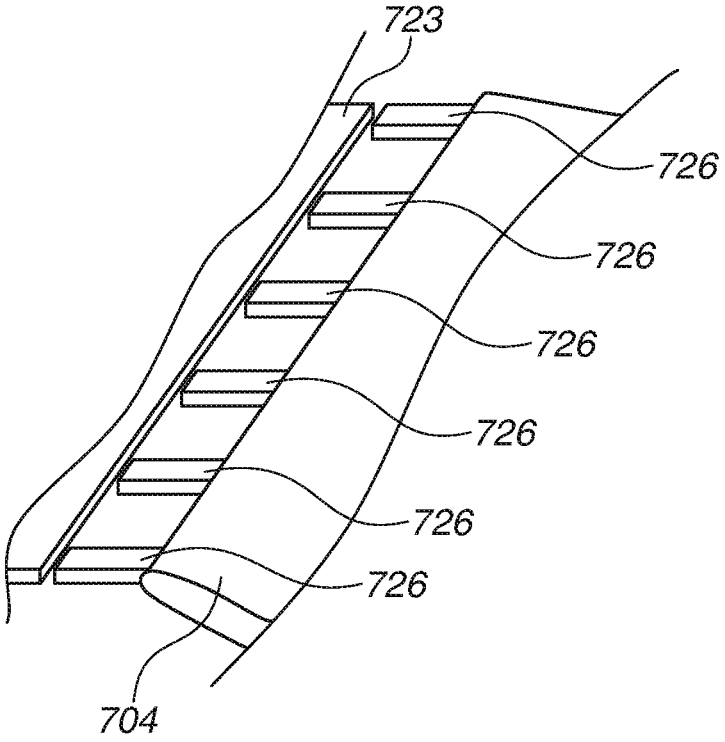
FIG. 11 is a schematic diagram of a modification example a guide member.

Moreover, in the exemplary embodiment, the shutter member extending in a sheet width direction intersecting with a conveyance direction as illustrated in FIG. 10 has been described as an example of the shutter member 725. However, a shape of the shutter member is not limited thereto. For example, a plurality of guide portions 726 each extending in the conveyance direction may be discretely arranged in the sheet width direction, so that such guide portions 726 may be used as the shutter member (see FIG. 11). In other words, in any of the exemplary embodiments, a guide member at the guide position blocks the scrap discharge path 711. Here, the blockage of the scrap discharge path 711 does not represent a case in which the scrap discharge path 711 is closed, which is understood from, for example, the guide member including the plurality of guide portions discretely arranged. The blockage of the scrap discharge path 711 indicates a state in which a sheet to be conveyed can be guided not to enter the scrap discharge path 711.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-109278, filed May 31, 2016, which is hereby incorporated by reference herein in its entirety.

What is claimed is:

1. A sheet processing apparatus comprising:

a pair of folding rollers configured to nip and fold a sheet;

a conveying unit configured to convey the folded sheet along a conveyance path;

a first blade;

a second blade configured to cut the folded sheet which has passed through the conveyance path, with the first blade, wherein the first blade and the second blade are disposed above the pair of folding rollers;

a blowing unit configured to blow air to the first blade;

a scrap path through which scrap generated when the sheet is cut by the first and second blades and the air blown from the blowing unit pass and which is arranged under the first and second blades; and a storage unit configured to store scrap that has passed through the scrap path, wherein a virtual horizontal line intersects the scrap path and the conveyance path.

2. The sheet processing apparatus according to claim 1, further comprising a guide member configured to be movable to a first position where the guide member blocks the scrap path and the guide member guides the folded sheet conveyed and to a second position where the scrap is allowed to enter the scrap path, wherein the blowing unit blows air such that the air flows along the guide member at the second position into the scrap path.

3. The sheet processing apparatus according to claim 2, wherein the guide member is rotatably supported around an end portion on a side opposite to a cutting position at which the first and second blades cut the sheet.

4. The sheet processing apparatus according to claim 2, wherein, the blowing unit and the scrap path are in airflow communication with each other in a vertical direction in a case where the blowing unit is arranged above the cutting position, the scrap path is arranged below the cutting position, and the guide member is positioned in the second position.

5. The sheet processing apparatus according to claim 2, wherein the air blown from the blowing unit flows between a guide surface of the guide member and the first blade in a state where the guide member is positioned in the second position.

6. The sheet processing apparatus according to claim 1, wherein the blowing unit blows air such that the blown air that crosses the conveyance path and flows toward inside of the scrap path flows along a side surface of the first blade.

7. The sheet processing apparatus according to claim 2, wherein the blowing unit does not blow air while the sheet to be guided by the guide member positioned at the first position is being conveyed.

8. The sheet processing apparatus according to claim 1, wherein the blowing unit blows air to the first blade at least when the first and second blades cut the folded sheet.

9. The sheet processing apparatus according to claim 1, wherein the second blade is fixed and the first blade moves relative to the second blade, and wherein the blowing unit is configured such that air flows along a side surface of the first blade, the side surface extending along a movement direction of the first blade.

10. The sheet processing apparatus according to claim 1, wherein a second virtual horizontal line intersects at least one roller of the pair of folding rollers and the storage unit.

11. An image forming apparatus comprising:

an image forming unit configured to form an image on a sheet;

a pair of folding rollers configured to nip and fold a sheet, on which an image is formed by the image forming unit, at a nipping portion;

a conveying unit configured to convey the folded sheet along a conveyance path;

a first blade;

a second blade configured to cut the folded sheet which has passed through the conveyance path with the first blade, wherein the first blade and the second blade are disposed above the pair of folding rollers;

a blowing unit configured to blow air to the first blade;

a scrap path through which scrap generated when the sheet is cut by the first and second blades and the air blown from the blowing unit pass and which is arranged under the first and second blades; and a storage unit configured to store scrap that has passed through the scrap path;

wherein virtual horizontal line intersects the scrap path and the conveyance path.

* * * * *